US007604426B2

(12) United States Patent
Hanaoka et al.

(10) Patent No.: US 7,604,426 B2
(45) Date of Patent: Oct. 20, 2009

(54) PAPER CUTTING DEVICE AND A PRINTER WITH A PAPER CUTTING DEVICE

(75) Inventors: Yukihiro Hanaoka, Shiojiri (JP); Hiroyuki Nakayama, Shiojiri (JP)

(73) Assignee: Seiko Epson Corporation (JP)

( * ) Notice: Subject to any disclaimer, the term of this patent is extended or adjusted under 35 U.S.C. 154(b) by 373 days.

(21) Appl. No.: 11/595,323

(22) Filed: Nov. 8, 2006

(65) Prior Publication Data

US 2007/0107575 A1 May 17, 2007

(30) Foreign Application Priority Data

Nov. 16, 2005 (JP) ..... 2005-331443

(51) Int. Cl.
*B41J 11/00* (2006.01)

(52) U.S. Cl. ..... 400/621; 400/611

(58) Field of Classification Search ..... 400/621, 400/611

See application file for complete search history.

(56) References Cited

U.S. PATENT DOCUMENTS 6,109,154 A * 8/2000 Miyatsu et al. ..... 83/627
6,164,854 A * 12/2000 Otsuki ..... 400/621
6,405,625 B1 6/2002 Nomura et al.
7,059,793 B2 * 6/2006 Mori et al. ..... 400/621
2005/0150992 A1 * 7/2005 Morris et al. ..... 242/563

FOREIGN PATENT DOCUMENTS

| | | |
|---|---|---|
| CH | 1263500 | 8/2000 |
| CH | 1530240 | 9/2004 |
| JP | 05-104484 | 4/1993 |
| JP | 11-240216 | 7/1999 |
| JP | 2001-030558 | 2/2001 |

* cited by examiner

*Primary Examiner*—Anthony H. Nguyen
(74) *Attorney, Agent, or Firm*—Baker & Hostetler, LLP

(57) ABSTRACT

A paper cutting device for cutting sheet material from the lengthwise edges of the material toward the middle comprising a stationary blade and first and second movable blades with the sheet material placed between the stationary blade and the first and second movable blades. The paper cutting device enables the spacing between the stationary blade and the first and second movable blades to be opened by moving the stationary blade frame and the movable blade frame relative to each other. The first movable blade and second movable blade are supported on a first stud and second stud, respectively, near the distal ends of the edge of the blade part of the stationary blade so that the paths of the blade tips overlap when cutting the sheet material. The movable blade drive mechanism drives the first movable blade and second movable blade with the first movable blade leading and the second movable blade following.

12 Claims, 12 Drawing Sheets

PAPER CUTTING DEVICE AND A PRINTER WITH A PAPER CUTTING DEVICE

BACKGROUND OF THE INVENTION

1. Field of Invention

The present invention relates to a cutting device using a scissor action to cut from both lengthwise edges toward the widthwise center of a sheet material, and to a printer that uses the cutting device.

2. Description of Related Art

Paper cutting devices that have a stationary blade and a pair of movable blades supported to pivot freely at both end portions of the blade part of the stationary blade to cut paper with a scissor action from both lengthwise edges of the paper toward the widthwise center of the paper, and can operate in a full-cut mode cutting completely across the width of the paper to separate the cut-off portion from the paper roll or a partial cut mode that leaves the center portion of the paper uncut are known from the literature. See, for example, JP-A-H05-104484.

With this type of scissor cutter the gap between the stationary blade and the pair of movable blades cannot be opened because the movable blades are axially supported at the sides of the stationary blade. As a result, the paper must be fed through the gap between the cutter blades when loading paper.

The paper cutting device and printer having the paper cutting device according to the present invention enable loading paper easily between the stationary blade and pair of movable blades while also enabling cutting appropriately from both lengthwise edges toward the widthwise center of the paper.

SUMMARY OF THE INVENTION

A paper cutting device according to a first aspect of the invention has a stationary blade; a stationary blade frame for supporting the stationary blade; first and second movable blades; a movable blade frame for supporting the first and second movable blades on a first support pin and a second support pin, respectively, so that the first and second movable blades can pivot freely in a scissor cutting action with the stationary blade; and a movable blade drive mechanism for causing the first and second movable blades to cut. The stationary blade frame and the movable blade frame are movable in relation to each other to enable opening the paper transportation path between the stationary blade and the first and second movable blades; the first and second movable blades are supported by first and second support pins so that the blade tips are mutually opposed and the paths of tip movement overlap; and the movable blade drive mechanism links and drives the first and second movable blades to cut so that one movable blade leads and the other movable blade follows.

Recording paper can be easily loaded between the stationary blade and movable blades because the paper path opens as a result of the relative movement between the movable blade frame and stationary blade frame. The paper can also be cut partially or fully as a result of the paths of the tips of the movable blades overlapping during the cutting operation to cut the paper from both edges across the width of the paper.

Preferably, the movable blade drive mechanism has a single cutter motor; and a transfer mechanism for transferring drive power from the cutter motor to the first and second movable blades so that the first and second movable blades cut.

By thus driving two movable blades with a single motor, the parts count is reduced, the number of assembly steps is reduced, and space efficiency is improved.

Yet further preferably, the transfer mechanism has a crank wheel that receives power from the cutter motor and rotates; an input arm of which one end part engages a crank pin of the crank wheel so that the crank pin can slide freely and rotate freely, and the other end part is fixed to the first movable blade; and a connecting arm that is axially supported freely rotatably to the movable blade frame and freely slidably and rotatably engages the first and second movable blades.

This aspect of the invention enables efficient power conversion by means of a simple arrangement.

Yet further preferably, the connecting arm is axially supported near the first movable blade, and has a first engaging part near the pivot axis for engaging the first movable blade, and a second engaging part for engaging the second movable blade on the side away from the first engaging part.

The cutting timing of the first movable blade and the second movable blade can thus be reliably offset because the cutting operation of the first and second movable blades is mechanically controlled.

Yet further preferably, the stationary blade is supported at three points by means of first and second contact parts rendered at both end portions on the cutting edge side for contacting the movable blade frame, and a third contact part rendered in the middle on the side opposite the cutting edge for contacting the stationary blade frame.

This arrangement affords a reliable cutting action with the stationary blade and movable blades held in a suitable friction state causing no chatter in the stationary blade when the movable blades cut.

The paper cutting device of the present invention can thus partially cut the paper while leaving an extremely short uncut portion because the paths of the tips of the two movable blades overlap and the movable blades cross the stationary blade at different phases.

A printer according to another aspect of the invention has a main frame with a roll paper compartment for storing roll paper and a printing mechanism for printing on the roll paper; a cover frame being movable relative to the main frame and having a cover for opening and closing the roll paper compartment; a movable blade frame disposed to the main frame for supporting first and second movable blades with the blade tips in opposition; a stationary blade frame disposed to the cover frame for supporting a stationary blade; and a movable blade drive mechanism for driving the first and second movable blades in a scissor action with the stationary blade. The first and second movable blades are disposed so that the paths of the tips overlap, and the movable blade drive mechanism links and drives the first and second movable blades to cut so that one movable blade leads and the other movable blade follows.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a roll paper printer having a paper cutting device according to a preferred embodiment of the invention is described below with reference to the accompanying figures.

The roll paper printer 1 prints on roll paper S and then cuts the roll paper S so that the printed portion severed from the rest of the roll can be provided to the user. For brevity the paper cutting device of the invention described below operates in a partial cutting mode to leave a portion of the cut paper uncut at one point, for example.

This type of roll paper printer 1 is typically used as a receipt printer, and the uncut part of the partially cut printed portion is torn off by the operator and issued as a receipt.

Figure 1:
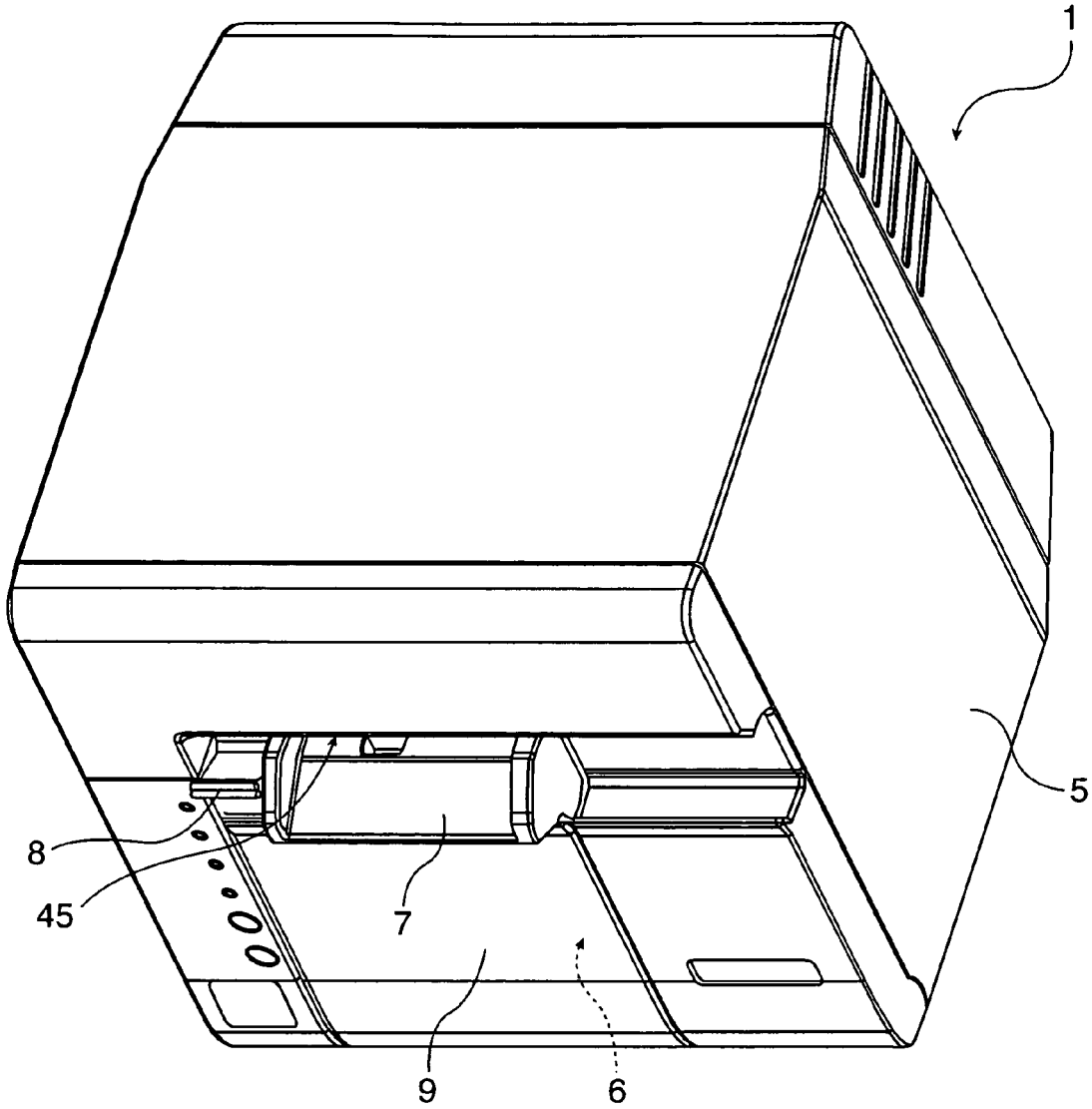
FIG. 1 is an external oblique view of a roll paper printer according to a preferred embodiment of the invention.
Figure 2:
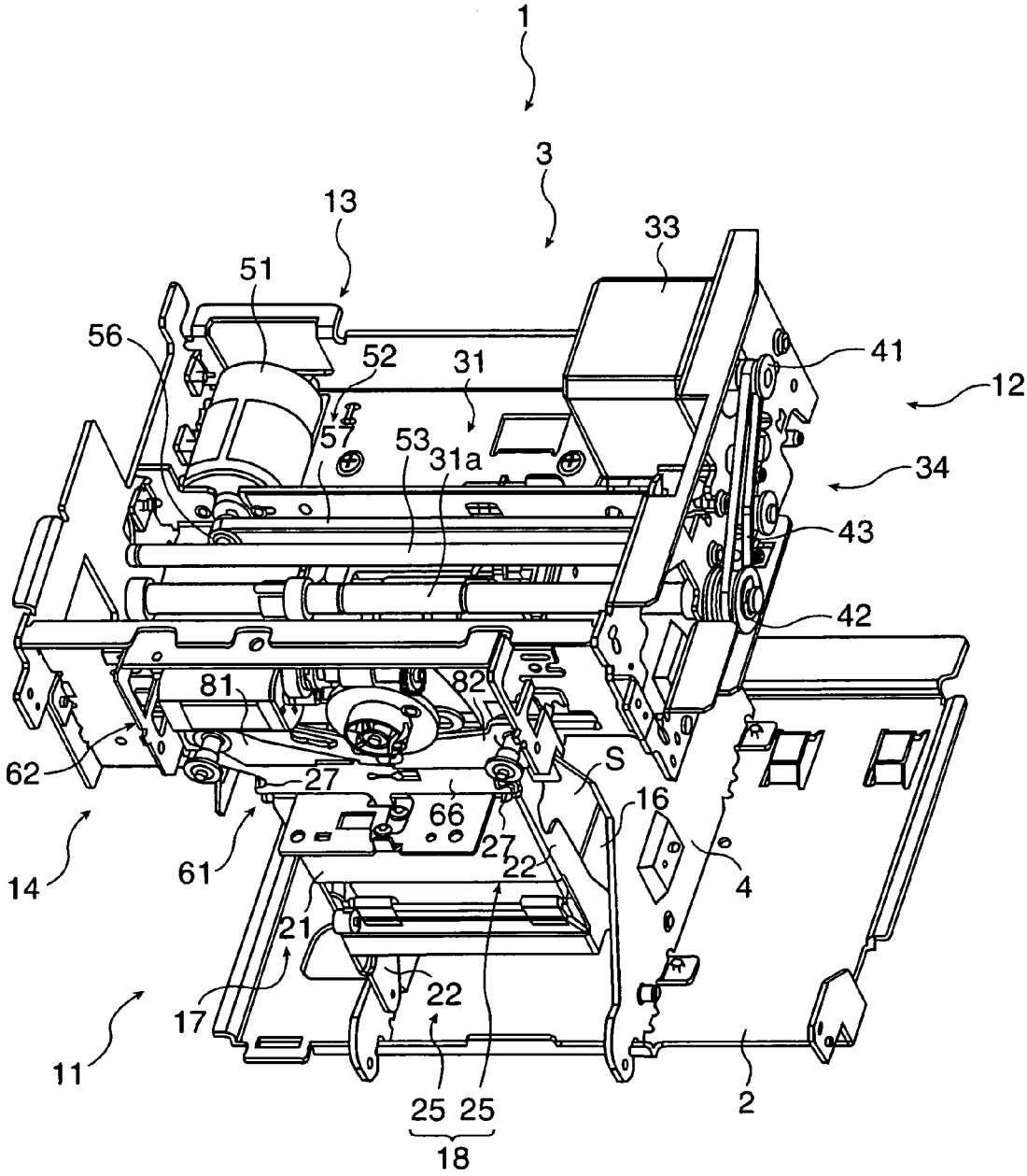
FIG. 2 is an oblique view showing the internal structure of the roll paper printer.
Figure 3:
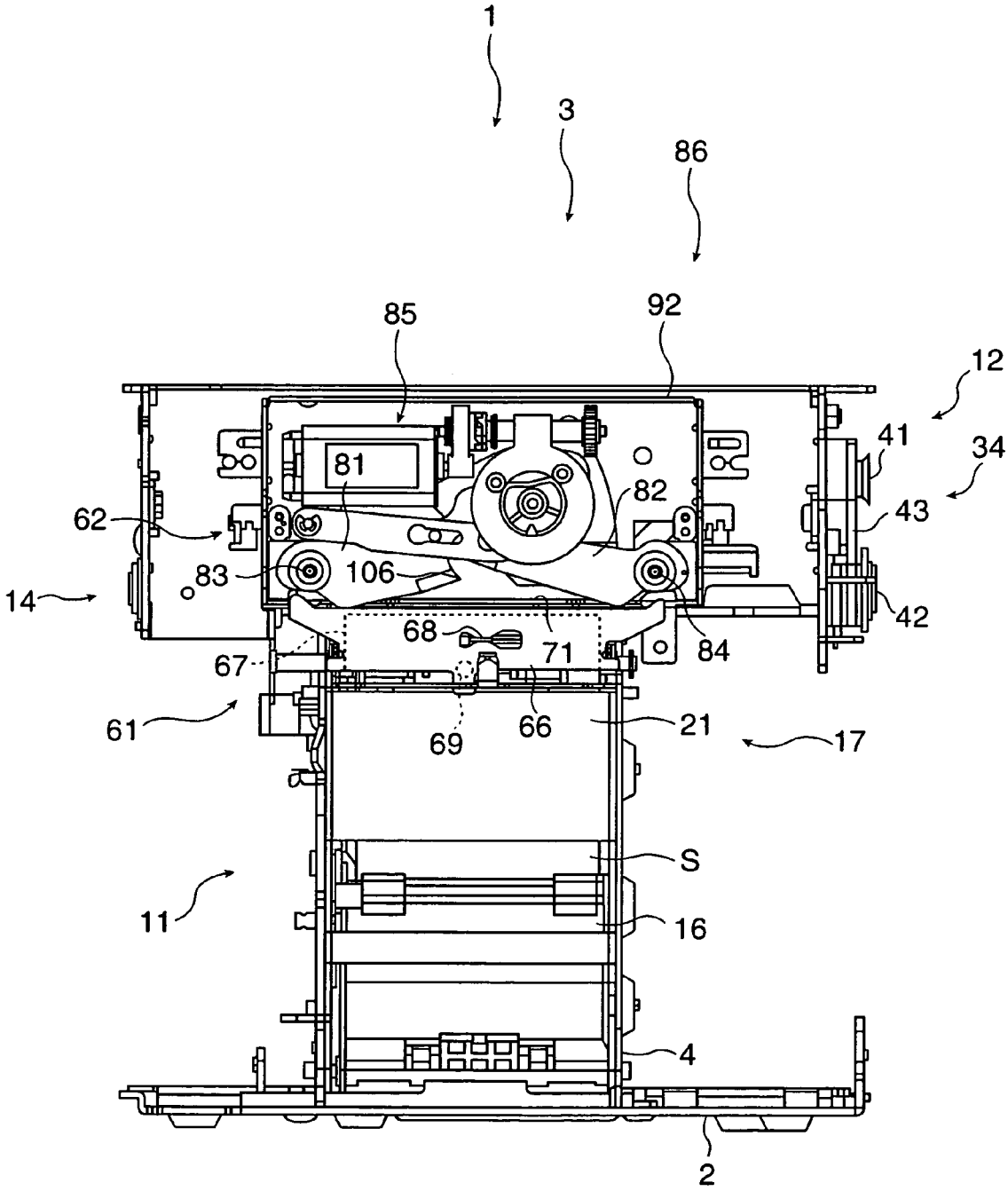
FIG. 3 is a front view of the roll paper printer.

As shown in FIG. 1 the printer 1 has a box-like external case 5 with a paper exit 45 of a specific width rendered in the front of the external case 5. A paper exit guide 7 projects to the front from below the paper exit 45, and a cover opening lever 8 is disposed beside the paper exit guide 7. A rectangular opening 6 is rendered below the paper exit guide 7 and cover opening lever 8 in the external case 5, and the opening 6 is closed by a cover 9 that can open to the front. Operating the cover opening lever 8 releases a cover locking mechanism not shown so that when the paper exit guide 7 is pulled forward the cover 9 pivots on the bottom end portion of the cover 9 and swings forward to a substantially horizontal open position.

Figure 4:
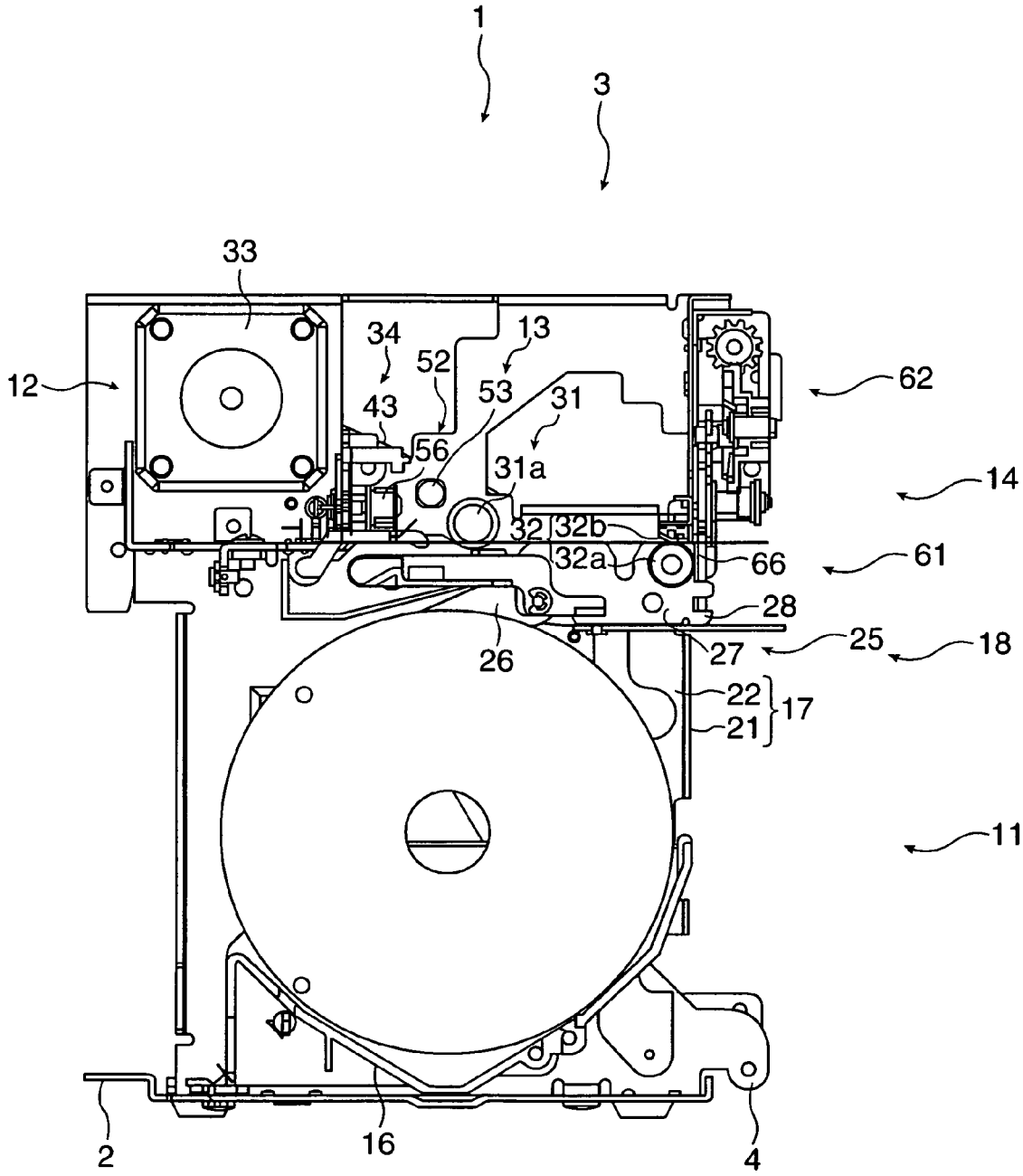
FIG. 4 is a side view of the roll paper printer with the roll paper cover closed.

A roll paper compartment 16 is rendered inside the printer. Opening the cover 9 opens the roll paper compartment 16 so that the roll paper S can be replaced and loaded from the front of the printer into the roll paper compartment 16 (see FIG. 4 and FIG. 5). The printer 1 is thus a front-loading printer having the paper exit 45 from which the printed portion of the roll paper S is discharged and the cover 9 that covers the opening 6 through which the roll paper S is loaded and replaced rendered at the front of the printer.

As shown in FIG. 2 to FIG. 5, a printer base 2 and a printer frame (main frame) 4 that rises vertically from the base 2 are disposed inside the external case 5. The internal mechanism 3 of the printer 1 is assembled on the main frame 4. A circuit board (not shown) for controlling printer 1 operation by controlling and coordinating the operation of the various parts of the internal mechanism 3 is also rendered inside the external case 5.

The internal mechanism 3 includes a roll paper loading mechanism 11 for loading the roll paper S, a paper transportation mechanism 12 for advancing the roll paper S in the subscanning direction through the paper path 46, a printing mechanism 13 having an inkjet head for printing on the roll paper S, and a paper cutter 14 (paper cutting device) for cutting (partially cutting in this embodiment of the invention) the roll paper S.

The roll paper loading mechanism 11 includes a drop-in type roll paper compartment 16 for holding the roll paper S to roll freely, the cover 9, and a cover opening/closing mechanism 18 for opening and closing the cover 9.

The cover 9 has a cover frame 17, and the cover frame 17 has a front portion 21 covering the front opening 6 to the roll paper compartment 16, and a pair of mounting arms 22 extending vertically on the right and left sides of the front portion 21. The bottom portions of the mounting arms 22 are axially supported freely rotatably at the front end portions of the legs of the main frame 4.

The cover opening/closing mechanism 18 comprises a pair of right and left parallel links 25. Each parallel link 25 includes a mounting arm 22 of the cover frame 17, a curved bar 26 disposed behind the mounting arm 22 with the bottom end portion supported freely rotatably on a leg portion of the main frame 4, and a support member 27 connecting the top portion of the mounting arm 22 and a top portion of the curved bar 26 to pivot freely, thus rendering a parallel link mechanism with four joints. More specifically, the link connecting where the bottom end of the mounting arm 22 is pivotably supported with where the bottom end of the curved bar 26 is pivotably supported functions as a fixed link enabling the support member 27 disposed parallel thereto to move while maintaining a horizontal posture.

The paper transportation mechanism 12 includes a transportation mechanism composed of an upstream feed roller 31 and a downstream feed roller 32, each of which is a gripper roller, a feed motor (such as a DC motor) 33 that is disposed at the rear right side of the main frame 4 and can rotate in both forward and reverse directions, an upstream transportation mechanism 34 for transferring power from the feed motor 33 to the upstream feed roller 31, a downstream transportation mechanism (not shown) for transferring power from the feed motor 33 to the downstream feed roller 32, and a pair of right and left feed guides (also not shown) for guiding the side edges of the roll paper S being conveyed.

The upstream feed roller 31 includes an upstream drive roller 31*a* located directly above the roll paper compartment 16 and axially supported freely rotatably on both left and right side portions of the main frame 4, and an upstream driven roller (not shown in the figures) located above the upstream drive roller 31*a* and axially supported freely rotatably on the left and right support members 27.

The downstream feed roller 32 includes a downstream driven roller 32*b* (a toothed roller) axially supported freely rotatably on the main frame 4 at a position near the paper cutter 14 on the downstream side in the transportation direction from the upstream feed roller 31, and a downstream drive roller 32*a* disposed above the downstream driven roller 32*b* and axially supported freely rotatably to the support members 27.

The upstream transportation mechanism 34 includes a drive pulley 41 connected to the feed motor 33, a driven pulley 42 connected to the upstream drive roller 31*a*, and a timing belt 43 connecting the drive pulley 41 and driven pulley 42.

The downstream transportation mechanism comprises a gear train (not shown in the figure) for reducing the speed of and transferring drive power from the feed motor 33 to the downstream drive roller 32*a*. The upstream drive roller 31*a* and downstream drive roller 32*a* are thus simultaneously driven rotationally by a common feed motor 33.

Figure 5:
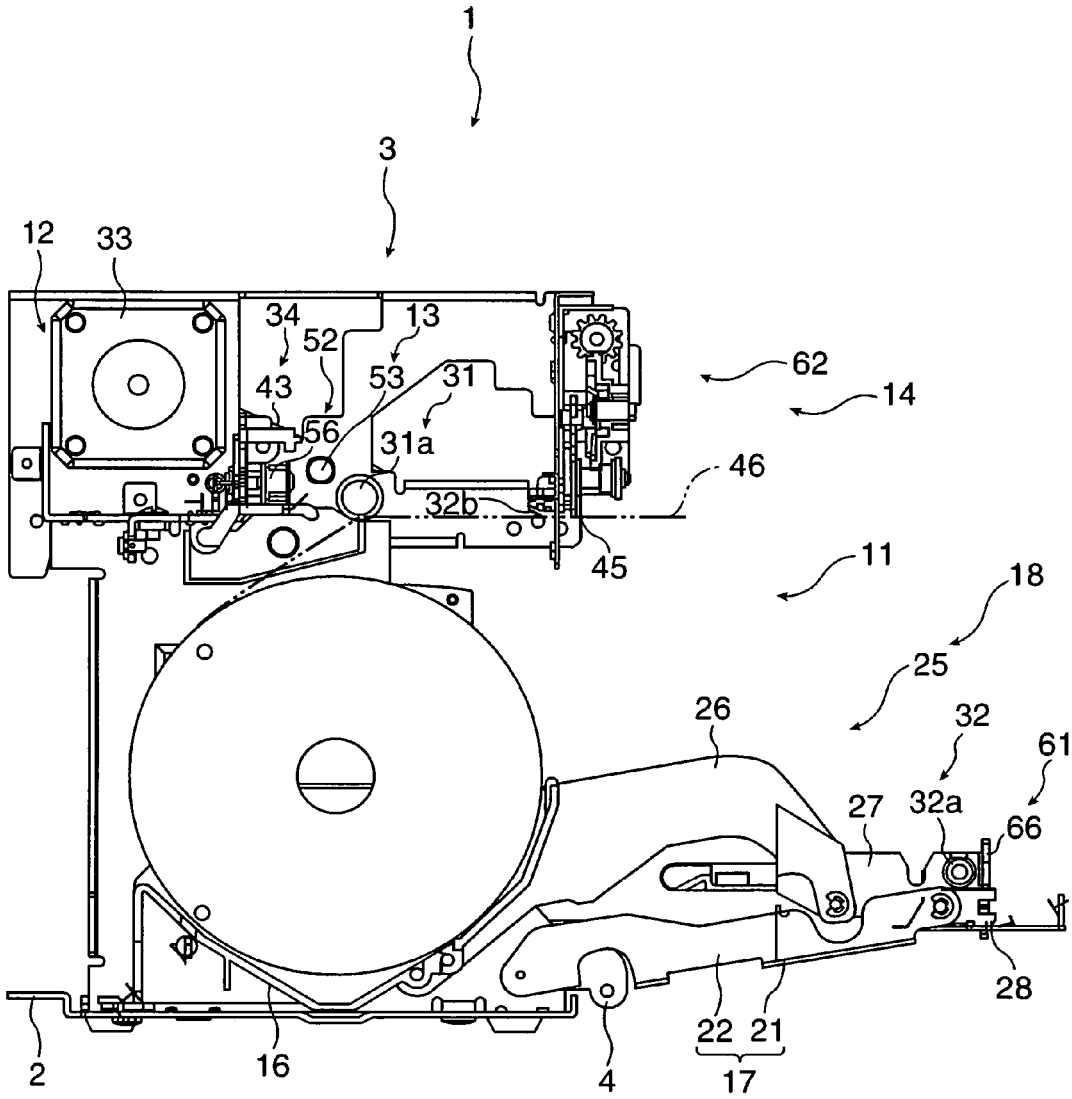
FIG. 5 is a side view of the roll paper printer with the roll paper cover open.

The roll paper S stored in the roll paper compartment 16 is conveyed by the upstream feed roller 31 and downstream feed roller 32 horizontally passed the printing position above the roll paper compartment 16, through the gap between the stationary blade 66 and the first and second movable blades 81 and 82 of the paper cutter 14, and out from the paper exit 45. More specifically, the path from the roll paper compartment 16 passed the upstream and downstream feed rollers 31 and 32 to the paper exit 45 is the paper path 46 of the roll paper S as shown in FIG. 5.

The position where the upstream and downstream feed rollers 31 and 32 nip the roll paper S is not at the widthwise center of the roll paper S but offset slightly to the left of center as seen from the downstream side. The roll paper S is thus positioned and conveyed with the right edge of the roll paper S against the right side paper guide.

The printing mechanism 13 include an inkjet head (not shown in the figures) for printing by discharging ink onto the roll paper S, a carriage (not shown in the figures) that carries the inkjet head, a carriage motor 51 such as a DC motor, a carriage moving mechanism 52 for transferring drive power from the carriage motor 51 to the carriage, and a guide member 53 for supporting the carriage slidably in a main scanning direction. The guide member 53 is located between the carriage moving mechanism 52 and the upstream feed roller 31, and is fixed to both sides of the main frame 4.

The carriage moving mechanism 52 includes a drive pulley 56 disposed on the left side of the printer 1 and connected to the carriage motor 51, a driven pulley (not shown in the figures) located on the right side of the printer 1, and a timing belt 57 connecting the drive pulley 56 and driven pulley.

The carriage is supported on the guide member 53 and holds the inkjet head facing the roll paper S passing through the paper path 46. The base end of the carriage is fixed to part of the timing belt 57 so that as the carriage motor 51 turns the carriage travels bidirectionally in the main scanning direction by way of intervening timing belt 57.

The printer 1 thus prints to the roll paper S by means of the paper transportation mechanism 12 and printing mechanism 13 thus comprised. More specifically, the printing mechanism 13 drives the inkjet head bidirectionally in the main scanning direction and discharges ink from the inkjet head synchronized to the intermittent travel of the roll paper S in the sub scanning direction by means of the paper transportation mechanism 12 to print on the roll paper S. The roll paper S is then advanced further and the paper cutter 14 partially cuts across the width of the trailing end of the printed portion of the roll paper S.

The paper cutter 14 that is the main part of the present invention is described next.

The paper cutter 14 is an automatic partial-cut paper cutter that is located on the downstream end of the paper path 46 and cuts across the width of the paper while leaving the middle portion uncut. The paper cutter 14 includes movable blade unit 62 and stationary blade unit 61 disposed vertically in facing relation on opposite side of the paper path 46 at the front of the main frame 4.

The stationary blade unit 61 includes stationary blade 66, stationary blade frame 67 supporting the stationary blade 66, and a connecting spring 68 (such as a coil spring shown in FIG. 9) connecting the stationary blade 66 and stationary blade frame 67 at the middle. The stationary blade 66 and stationary blade frame 67 are disposed with a slight gap therebetween in the front to back direction of the printer with the connecting spring 68 urging the stationary blade 66 towards the stationary blade frame 67.

The stationary blade frame 67 is supported by a pair of left and right support members 27, and can move the stationary blade unit 61 relative to the movable blade unit 62 in conjunction with opening and closing the cover frame 17. More specifically, opening the cover frame 17 separates the stationary blade unit 61 and movable blade unit 62 and opens the paper path 46. As a result, the roll paper S can be easily set between the stationary blade 66 and the first and second movable blades 81 and 82 by simply opening the cover 9, dropping roll paper S into the roll paper compartment 16 and pulling the leading end of the roll paper S out, and then closing the cover 9.

Figure 6:
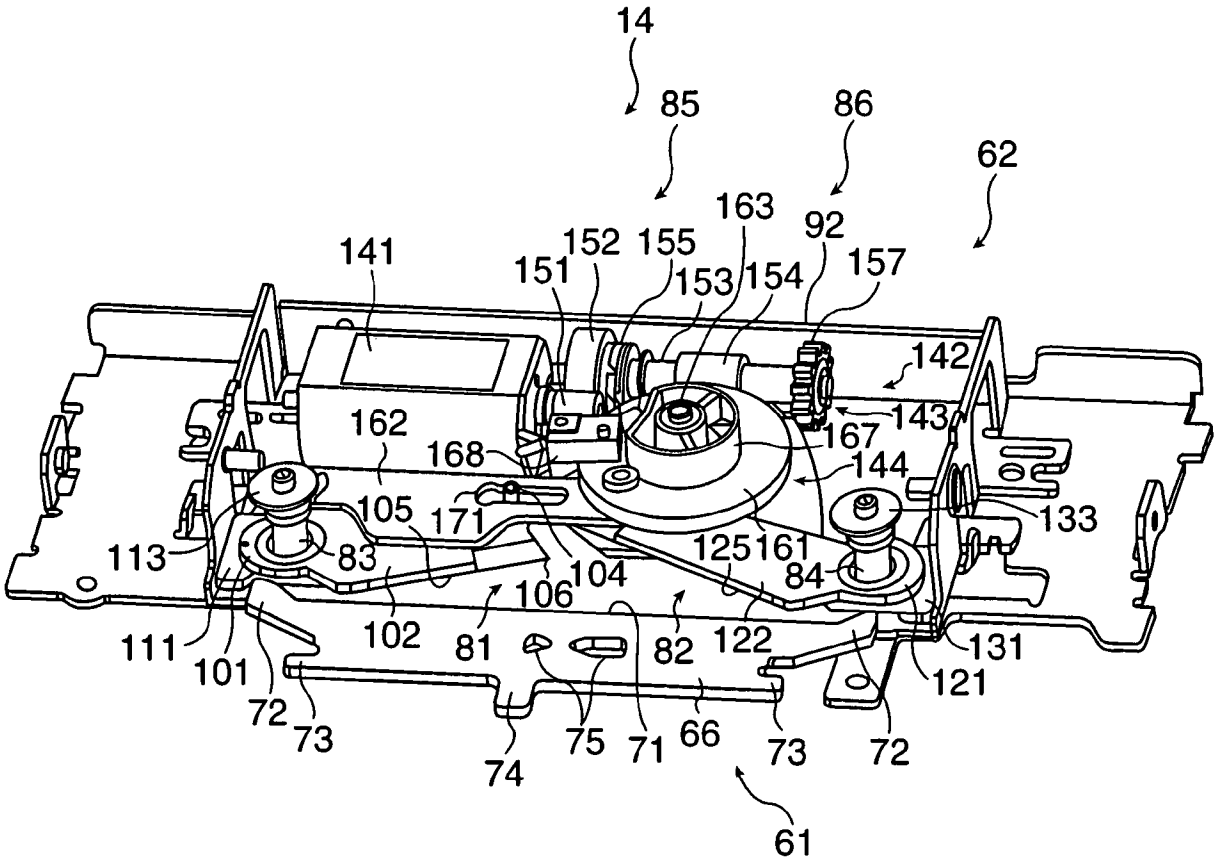
FIG. 6 is an external oblique view of the paper cutting device when the front cover of the movable blade removed.
Figure 7:
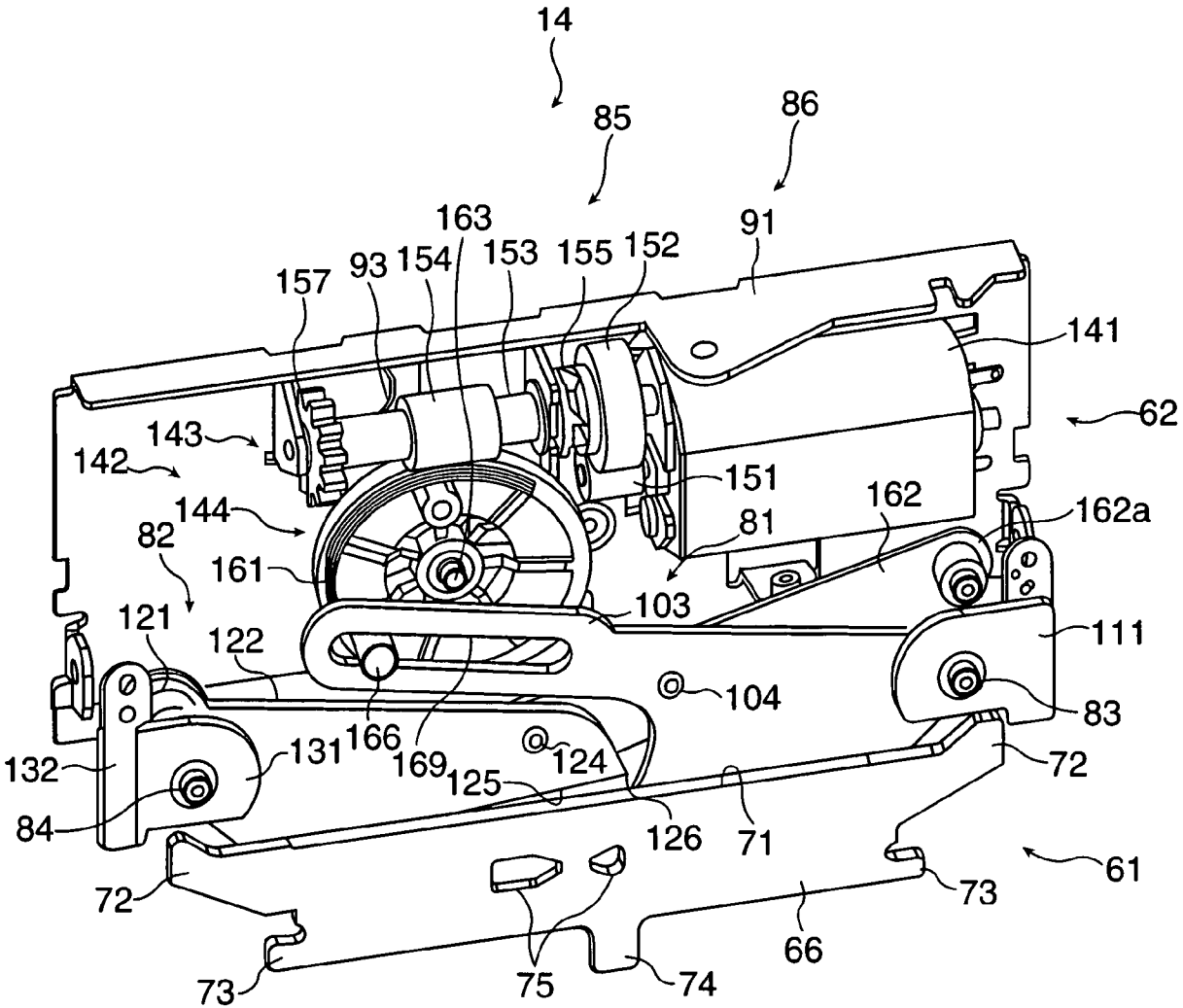
FIG. 7 is an external oblique view of the paper cutting device when the back cover of the movable blade removed.

As shown in FIG. 6 and FIG. 7, the stationary blade 66 is a plate that is made from steel or other metal and is substantially rectangular when seen from the front, and has a straight blade part 71 rendered on the top. The stationary blade 66 also has a pair of upward protrusions 72 (first and second contact parts) rendering projecting upward from the left and right ends parts of the top of the stationary blade 66, a pair of outward protrusions 73 formed projecting to the outside from the bottom left and right ends, and a downward protrusion 74 (third contact part) formed projecting downward from the middle part of the bottom edge of the stationary blade 66. Large and a small spring catch holes 75 in which a hook of the connecting spring 68 is caught are formed substantially in the middle of the stationary blade 66.

The stationary blade 66 is vertically supported with the pair of outward protrusions 73 engaging stationary blade positioning units 28 that are substantially C-shaped when seen from the side and are formed at the front bottom part of the pair of support members 27, and is urged by the connecting spring 68 disposed between the spring catch holes 75 and the stationary blade frame 67.

Because the support member 27 moves while being held horizontally when the cover frame 17 is opened and closed by the cover opening/closing mechanism 18, the stationary blade 66 supported on the support members 27 by way of the stationary blade frame 67 also moves while held vertically. As a result, opening and closing the cover frame 17 does not change the position where the stationary blade 66 contacts the first and second movable blades 81 and 82.

When the cover frame 17 is closed, the pair of upward protrusions 72 of the stationary blade 66 contact the movable blade frame 86, and the downward protrusion 74 contacts a pin 69 protruding at the bottom center part of the stationary blade frame 67. The stationary blade 66 is thus supported at three points, the pair of upward protrusions 72 and downward protrusion 74, while being pulled to the back by the connecting spring 68. The stationary blade 66 and first and second movable blades 81 and 82 are thus positioned to slide against each other to cut while rubbing against each other with no play in the stationary blade 66 when the first and second movable blades 81 and 82 slide across the stationary blade 66. The stationary blade 66 is also positioned vertically as a result of the outward protrusions 73 engaging the stationary blade positioning units 28 as described above.

As shown in FIG. 6 and FIG. 7, the movable blade unit 62 includes a first movable blade 81 supported to pivot freely on a first stud 83, a second movable blade 82 that is longer than the first movable blade 81 and is supported to pivot freely on a second stud 84, a movable blade drive mechanism 85 for driving the first and second movable blades 81 and 82 to cut with a scissor action, and a movable blade frame 86 for supporting the first and second movable blades 81 and 82 and movable blade drive mechanism 85.

The movable blade frame 86 is a rectangular case split into two front and back parts including a front frame 91 positioned in front and a back frame 92 positioned in back. The components of the movable blade drive mechanism 85 are disposed to the front frame 91. The first stud 83 and second stud 84 rendered as rivet pins project from the left and right bottom corner portions (on the stationary blade 66 side), and the first and second movable blades 81 and 82 are supported on these studs 83 and 84. A connecting arm 162 for linking the first and second movable blades 81 and 82 is axially supported freely rotatably near the top of the first stud 83.

The first movable blade 81 and second movable blade 82 are supported by the first stud 83 and second stud 84, respectively, above the blade part 71 of the stationary blade 66 with the blade parts 105, 125 of the movable blades facing downward opposite the stationary blade 66 with the paper exit 45 therebetween. The first and second movable blades 81 and 82 are further disposed with the tips 106 and 126 of the first and second movable blades 81 and 82 in opposition with the path of the tips 106 and 126 overlapping in order to enable a partial cut. The width of the uncut portion left by partial cutting is determined by the distance between the first movable blade 81 and second movable blade 82. More particularly, the gap between the position of the tip 106 of the first movable blade 81 against the blade part 71 of the stationary blade 66 and the position of the tip 126 of the second movable blade 82 against the blade part 71 of the stationary blade 66 determines the uncut width. By changing this width between the tips of the cutting edges of the movable blades the paper cutting device can be reconfigured to operate in a full-cut mode cutting across the entire width of the roll paper S.

The first movable blade 81 is preferably steel, and is composed of a base end part 101, base part 102, and an input arm part 103 formed in unison. The base end part 101 has a hole through which the first stud 83 passes. The base part 102 to which the blade part 105 is formed is contiguous to the base end part 101. The input arm part 103 extends from the distal end part of the top (the side opposite the blade part 105) of the base part 102 and engages the crank arm 166. A first engaging pin 104 for engaging connecting arm 162 protrudes at the top distal end part of the base part 102. The blade part 105 is slightly curved like a drum from the base end part 101 side to the tip 106 so that the cutting angle is substantially the same at all points of contact with the roll paper S. The angle of the blade part is also sharper near the tip 106 than at the base end part 101.

Figure 8:
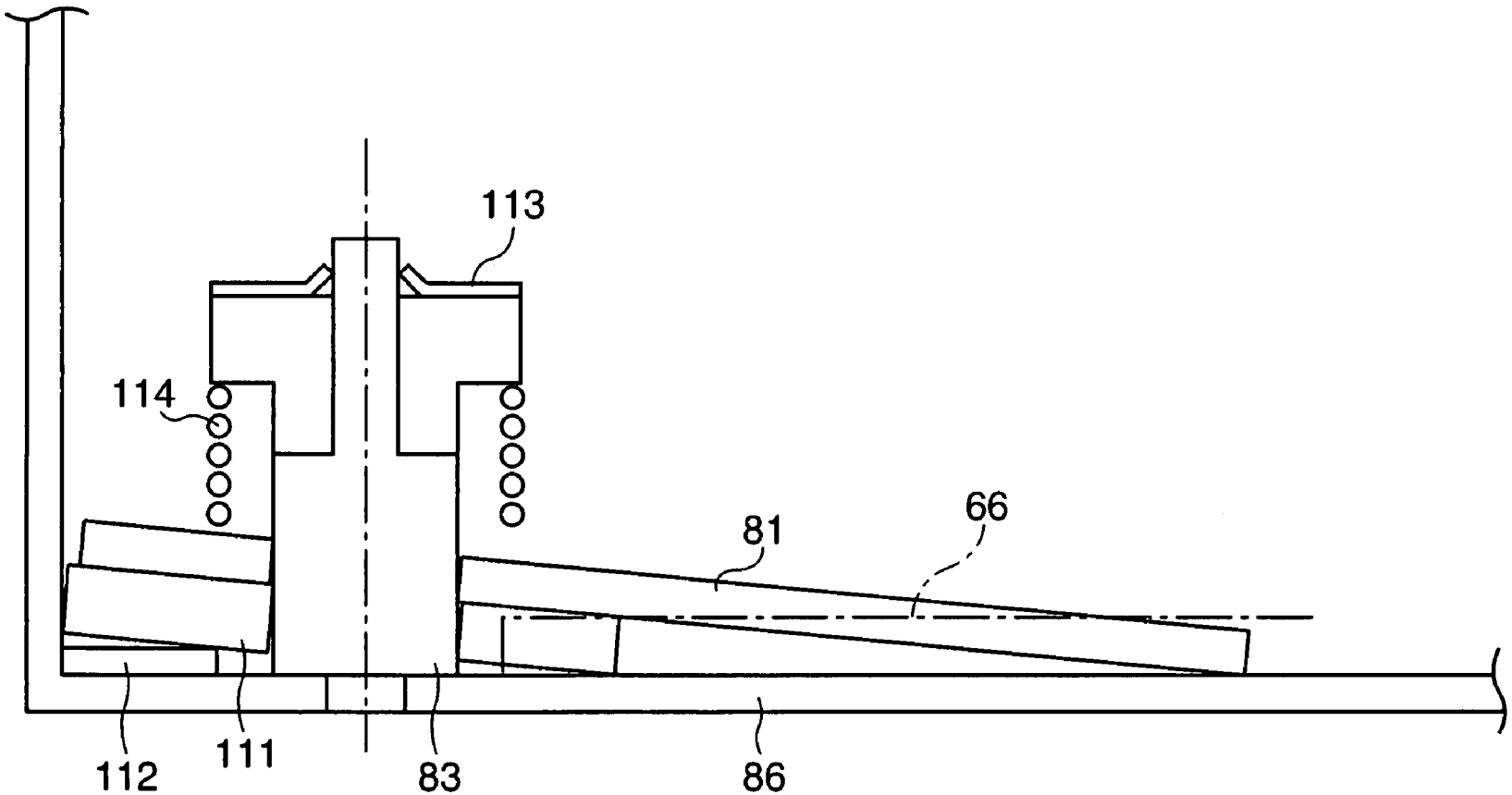
FIG. 8 schematically describes the portion around the support pin of the first movable blade.

As shown in FIG. 8, a first movable blade receiver 111 (first receiving member) of substantially the same thickness as the stationary blade 66 is fit onto the first stud 83 with the first movable blade receiver 111 interposed between the base end part 101 of the first movable blade 81 and the back frame 92. A long slender first spacer 112 that is thinner than the first movable blade receiver 111 is disposed between the left end part of the first movable blade receiver 111 (the end part on the opposite side of the first stud 83 than the tip 106). As a result, the tip 106 of the first movable blade 81 is at the same level as the mounting surface of the back frame 92, but the base end part 101 is offset from the mounting surface of the back frame 92 so that the point where the first movable blade 81 starts to intersect the stationary blade 66 is offset at least the thickness of the stationary blade 66 from the mounting surface of the back frame 92.

A first push nut 113 is fixed on the distal end of the first stud 83, and a first adjustment spring 114 (a coil spring) for urging the first movable blade 81 to the back frame 92 is disposed between the first push nut 113 and first movable blade 81. As a result, the tip 106 of the first movable blade 81 gradually separates from the mounting surface of the back frame 92 as the first movable blade 81 pivots while the blade part 105 slides over the blade part 71 of the stationary blade 66 in resistance to the first adjustment spring 114. The blade part 105 of the first movable blade 81 therefore slides against the blade part 71 of the stationary blade 66 with appropriate force from the base end part 101 side to the tip 106.

The second movable blade 82 is also preferably steel, and is composed of a base end part 121 and a base part 122 formed in unison. The base end part 121 has a hole through which the second stud 84 passes. The base part 122 to which the blade part 125 is formed is contiguous to the base end part 121. A second engaging pin 124 for engaging connecting arm 162 protrudes at the top distal end part of the base part 122. Similarly to the blade part 105 of the first movable blade 81, the blade part 125 is slightly curved like a drum from the base end part 121 side to the tip 126, and the angle of the blade part near the tip 126 is acute.

Similarly to the first stud 83, a second movable blade receiver 131 (second receiving member), second spacer 132, second push nut 133, and second adjustment spring (not shown in the figures) are disposed to the second stud 84 so that the second movable blade 82 starts to intersect and ride over the stationary blade 66 from the base end part 121 so that the blade part 125 of the second movable blade 82 slides against the blade part 71 of the stationary blade 66 with appropriate force from the base end part 121 to the tip 126.

Because the blade part 125 of the second movable blade 82 disposed on the right side when viewed from the downstream side is longer than the blade part 105 of the first movable blade 81 disposed on the left side in the same view, the tips 106 and 126 are positioned offset to the left side from the center of the width of the paper. The tips 106 and 126 are adjusted to substantially the same widthwise position relative to the nipping position of the upstream feed roller 31 and downstream feed roller 32 (more specifically, relative to the center of the transportation force of the feed rollers 31 and 32). As a result, the force that pulls the roll paper S in the cutting direction (downward) and works when the roll paper S is cut is greatest near the tips 106 and 126, but because the roll paper S is nipped at substantially the same position widthwise to the paper, the position of the roll paper S does not shift across the paper width.

As shown in FIG. 6 and FIG. 7, the movable blade drive mechanism 85 includes a cutter motor 141 such as a DC motor, and a transfer mechanism 142 for transferring the power of the cutter motor 141 to the first and second movable blades 81 and 82 to cut.

The transfer mechanism 142 includes a speed reducing gear train 143 for transferring the power of the cutter motor 141 while reducing the speed, and a linkage mechanism 144 for causing the first movable blade 81 and second movable blade 82 to rock in unison by means of the drive power transferred from the gear train 143.

The gear train 143 includes a pinion gear 151 fixed to the output shaft of the cutter motor 141, a middle gear 152 that meshes with the pinion gear 151, and a worm shaft 153 having a worm 154 disposed at approximately the center in the axial direction of the worm shaft 153. The connection between the middle gear 152 and worm shaft 153 renders a clutch 155 for a torque limiter, and a slip spring 156 (coil spring, see FIG. 9) is disposed on the side of the middle gear 152 opposite the worm shaft 153. This spring allows the middle gear 152 to slip to prevent overloading the cutter motor 141.

A thumb wheel 157 (manual operating member) for manually turning the worm shaft 153 is disposed on the opposite end of the worm shaft 153 from the middle gear 152. The thumb wheel 157 can be manually rotated through a window 93 (opening) rendered in the mounting surface of the front frame 91 to operate the first and second movable blades 81 and 82.

The linkage mechanism 144 includes a crank wheel 161 (worm wheel), the input arm part 103 of the first movable blade 81, and the connecting arm 162. The crank wheel 161 engages the worm 154 and is thus driven rotationally by power transferred from the cutter motor 141 by the intervening worm 154. The input arm part 103 of the first movable blade 81 engages the crank arm 166 (linkage part) of the crank wheel 161. The connecting arm 162 engages the first movable blade 81 and second movable blade 82, and the base end part 162*a* of the connecting arm 162 is axially supported so that it is freely rotatable relative to the back frame 92.

The crank wheel 161 is supported and freely rotatably on a circular support pin 163 disposed projecting from the mounting surface of the front frame 91, and the crank arm 166 is disposed projecting parallel to the rotational axis at an eccentric position on the surface opposite the back frame 92. A cylindrical cam 167 for position detection is disposed integrally to the surface of the crank wheel 161 facing the front frame 91, and a home position detector 168 (such as a microswitch) contacts the outside surface of the cam 167. The cam 167 has a flat enabling home position detection, and displacement of the cutter (first and second movable blades 81 and 82) as the crank wheel 161 rotates is detected by the home position detector 168.

A crank slot 169 is rendered in the input arm part 103 of the first movable blade 81 with the long axis of the slot in line with the long axis of the arm so that the crank arm 166 can slide and rotate freely in the crank slot 169. The crank wheel 161 and input arm part 103 thus render a lever and crank mechanism that converts the rotational movement of the crank wheel 161 to the rocking motion of the input arm part 103 (that is, first movable blade 81).

Figure 11:
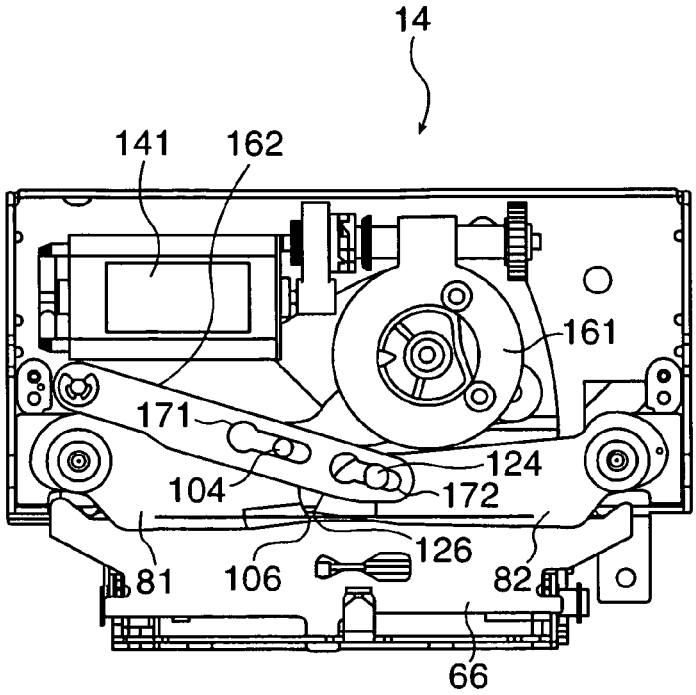
FIG. 11 is a front view of the paper cutting device when the tip of the first movable blade has passed the stationary blade.
Figure 12:
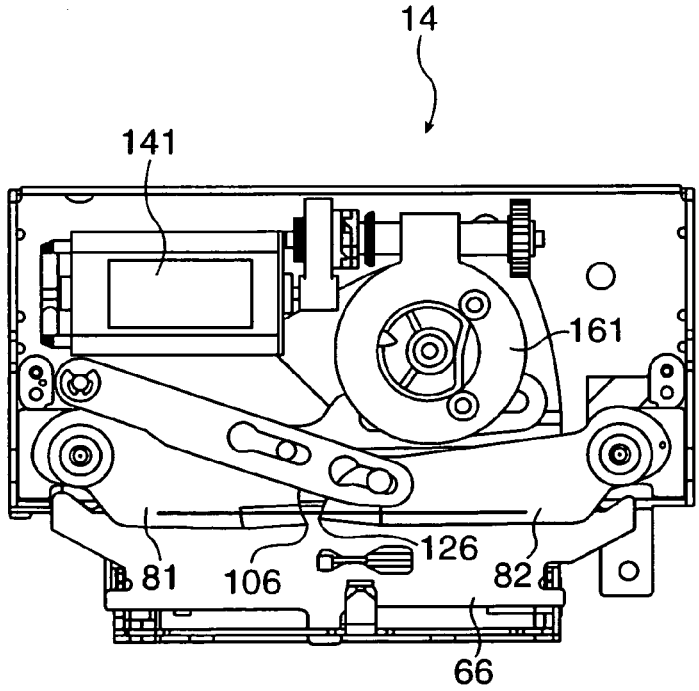
FIG. 12 is a front view of the paper cutting device when the tip of the second movable blade has passed the stationary blade.
Figure 13:
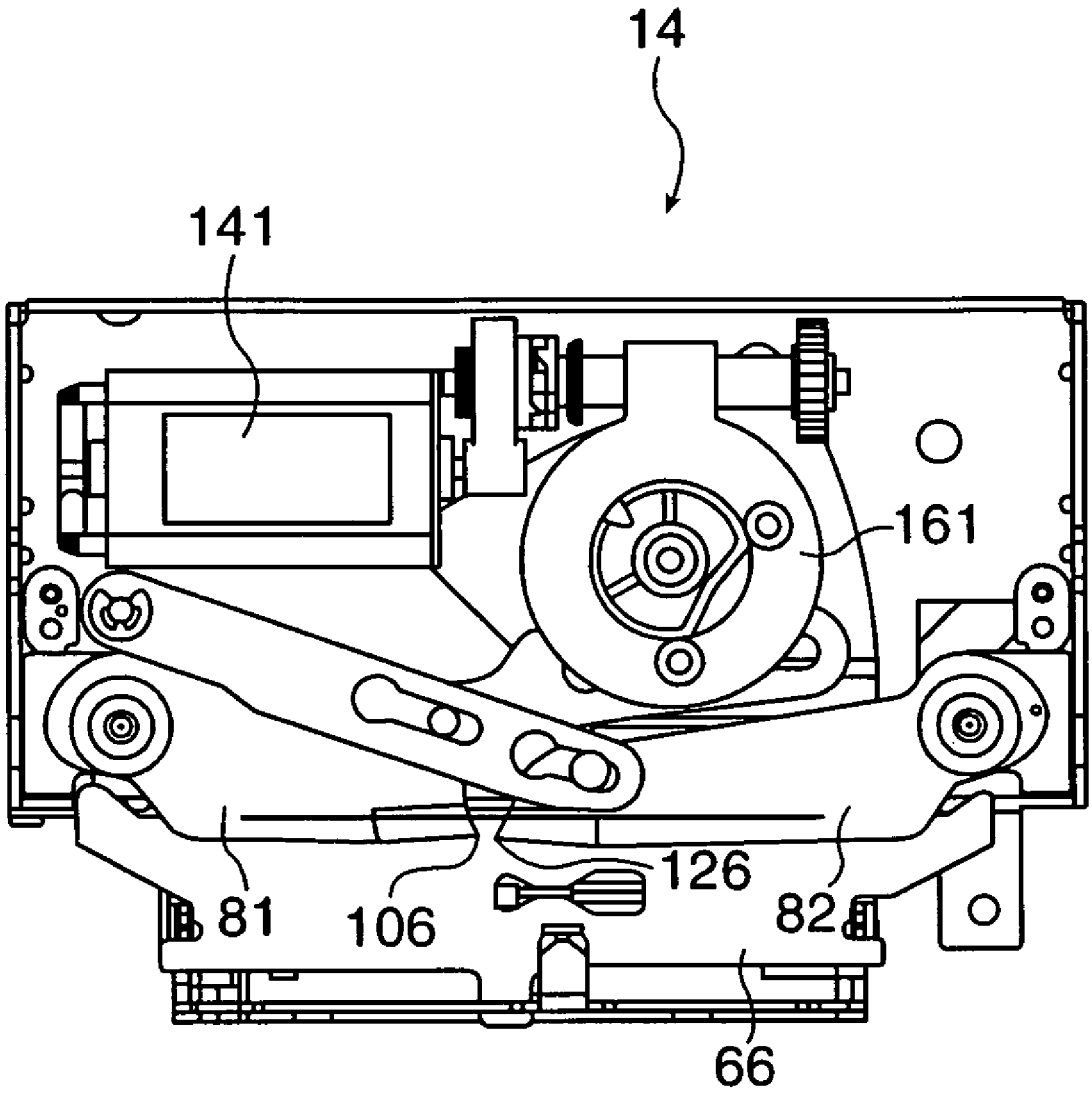
FIG. 13 is a front view of the paper cutting device when the first and second movable blades have reached the end of cutting position (bottom dead center).

As shown in FIG. 11, a first slot 171 (first engaging part) is rendered in the middle and a second slot 172 (second engaging part) is rendered in the distal end part of the connecting arm 162 with the long axes of the slots in line with the long axis of the connecting arm 162. The first slot 171 engages and allows the first engaging pin 104 of the first movable blade 81 to slide and rotate freely in the slot, and the second slot 172 engages and allows the second engaging pin 124 of the second movable blade 82 to slide and rotate freely in the slot.

When the lever and crank mechanism causes the first movable blade 81 to pivot, the first engaging pin 104 engaged with the first slot 171 rotates and causes the connecting arm 162 to pivot while the second engaging pin 124 engaged in the second slot 172 causes the second movable blade 82 to pivot. Because the base end part 162*a* of the connecting arm 162 is axially supported near the first movable blade 81, the distance between the base end part 162*a* and the second engaging pin 124 of the second movable blade 82 is greater than the distance between the base end part 162*a* and the first engaging pin 104 of the first movable blade 81. As a result, the second movable blade 82 moves faster than the first movable blade 81.

The paper cutter 14 according to this embodiment of the invention can thus convert torque from a single cutter motor 141 to the cutting operation (circular movement) of the first and second movable blades 81 and 82, thus efficiently converting drive power by means of a simple arrangement. The number of parts can therefore be reduced, the number of assembly steps can be reduced, and space efficiency can be improved.

Figure 14:
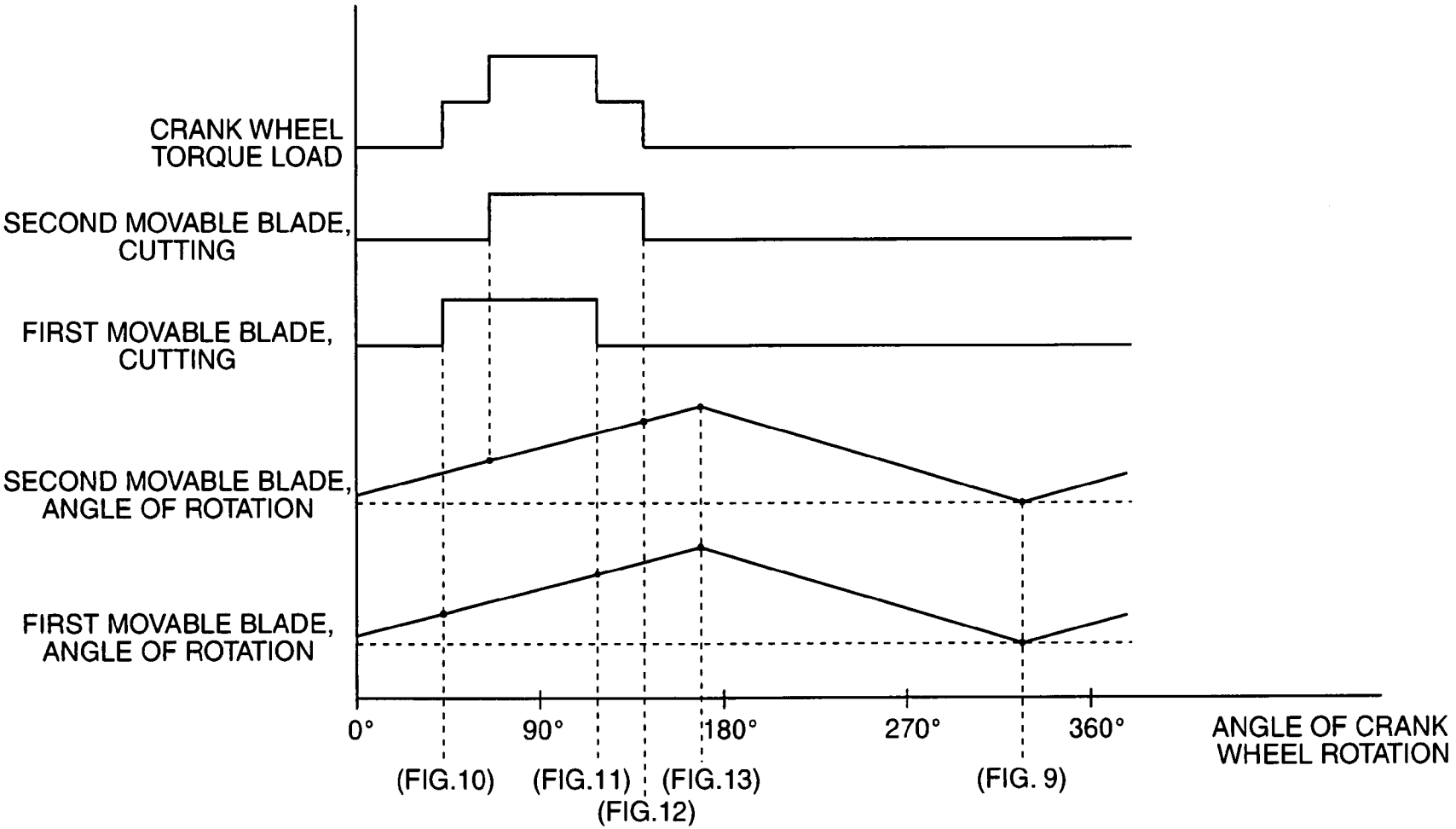
FIG. 14 describes the relationship between the angle of rotation of the crank wheel and the circular movement of the first and second movable blades.

The cutting operation of this paper cutter 14 is described next. FIG. 9 to FIG. 13 show the cutting operation over time, and FIG. 14 describes the relationship between rotational angle of the crank wheel 161 and the circular movement of the first and second movable blades 81 and 82.

Figure 9:
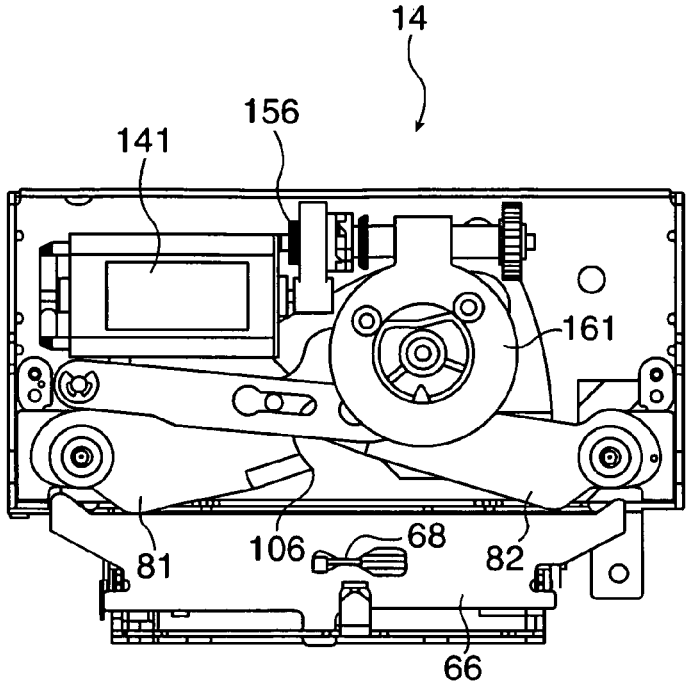
FIG. 9 is a front view of the paper cutting device when the first and second movable blades are at the cutting operation start position (top dead center).
Figure 10:
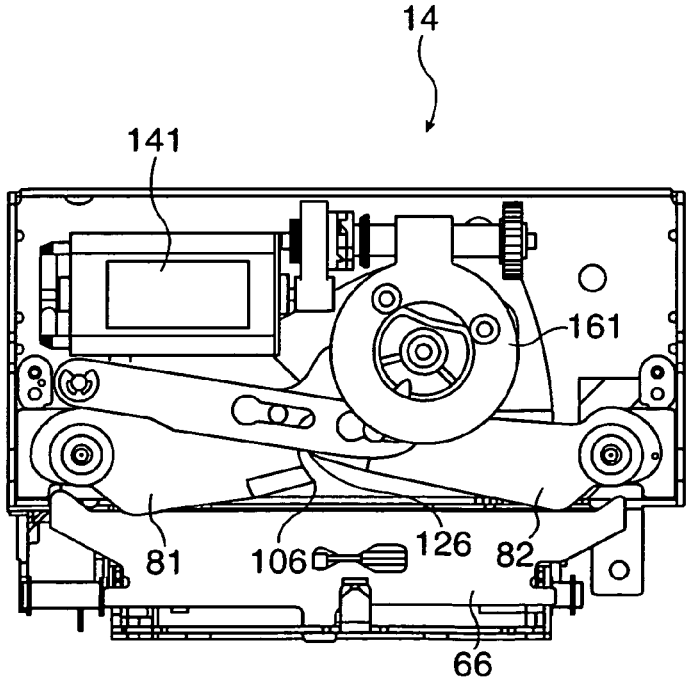
FIG. 10 is a front view of the paper cutting device when first movable blade starts to intersect the stationary blade.

The top dead center is the home position of the first and second movable blades 81 and 82 as shown in FIG. 9, and the cutting operation starts from this home position. The home position detector 168 is off when the first and second movable blades 81 and 82 are in the home position.

When the cutter motor 141 is driven forward, the crank wheel 161 rotates, the home position detector 168 goes from off to on, and the first and second movable blades 81 and 82 begin to pivot. The first movable blade 81 starts to intersect the stationary blade 66 first (see FIG. 10) and then the second movable blade 82 starts to intersect the stationary blade 66. The first and second movable blades 81 and 82 scissor cut the roll paper S by sliding across the stationary blade 66.

As the first and second movable blades 81 and 82 continue to pivot, the tip 106 of the first movable blade 81 passes the blade part 71 of the stationary blade 66 first (FIG. 11), the tip 126 of the second movable blade 82 then passes the blade part 71 of the stationary blade 66 (see FIG. 12), and cutting the roll paper S ends. The first and second movable blades 81 and 82 continue to pivot downward briefly after cutting the roll paper S ends until they reach the bottom dead center position (end position in cutting direction) (see FIG. 13). The angle of rotation of the crank wheel 161 required for the cutting operation from the point where the first movable blade 81 starts to cut (FIG. 10) to where the second movable blade 82 finishes cutting (FIG. 12) is approximately 110° (see FIG. 14).

After reaching bottom dead center at the end of the cutting stroke, the first movable blade 81 starts moving upward first followed by the second movable blade 82, return simultaneously to the home position (top dead center) at the end of the return stroke, and thus complete the cutting operation. The crank wheel 161 turns one revolution at this time and returns to the starting position, and the home position detector 168 switches from on to off. That the first and second movable blades 81 and 82 have returned to the home position can thus be detected.

The first movable blade 81 and second movable blade 82 pivot downward on the cutting stroke with the first movable blade 81 leading and the second movable blade 82 following, start sliding across the stationary blade 66 in the same sequence, and then reach the bottom dead center simultaneously. Because the second movable blade 82 moves faster than the first movable blade 81, the second movable blade 82 catches up with the first movable blade 81 at the bottom dead center.

Because the timing at which the first movable blade 81 and second movable blade 82 start cutting the roll paper S is offset, the peak cutting resistance (peak torque load on the crank wheel) of the movable blades 81 and 82 does not occur at the same time. A heavy load is therefore not momentarily applied to the cutter motor 141, and a motor with a large rated output is not required.

The roll paper S is also pulled in the cutting direction of the first and second movable blades 81 and 82 while being cut, and there is a chance that the uncut portion of the paper will be torn by this pulling force if the second movable blade 82 cuts into the paper while tension from the first movable blade 81 is pulling on the uncut portion. The present invention avoids this problem, however, by offsetting the timing at which the first and second movable blades 81 and 82 finish cutting the roll paper S. As a result, the uncut part left by partial cutting can be quite short.

A roll paper printer 1 according to this embodiment of the invention thus enables setting the roll paper S easily between the stationary blade 66 and the first and second movable blades 81 and 82, and enables partially cutting the roll paper S from both lengthwise edges toward the center of the paper.

Partial cutting leaving an extremely short uncut portion is also possible because the paths of the tips 106 and 126 of the first and second movable blades 81 and 82 overlap and intersect the stationary blade 66 at different times.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a main frame having a roll paper compartment for storing roll paper and a printing mechanism for printing on the roll paper adapted to be moved along a given transportation path;

a cover frame movably connected to the main frame and having a cover for opening and closing the roll paper compartment;

a movable blade frame disposed to the main frame for supporting first and second movable blades with each blade having a blade tip with the blade tips in mutually opposed relationship;

a stationary blade frame disposed to the cover frame for supporting a stationary blade in a position substantially transverse to the transportation path during cutting; and a movable blade drive mechanism for driving the first and second movable blades to cut the roll paper in a scissor action against the stationary blade;

wherein the movable blade drive mechanism links and drives the first and second movable blades such that one movable blade leads and the other movable blade follows with the movable blades disposed such that the paths of the tips overlap during the cutting of paper.

2. The printer of claim 1, wherein the movable blade drive mechanism comprises:

a motor;

a worm that is disposed parallel to the motor shaft of the motor and rotates as the motor is driven;

a worm wheel engaging the worm and having a linkage part protruding parallel to the axis of worm wheel rotation;

an arm rendered in unison with the first movable blade an having a slot engaging the linkage part; and a connecting arm having an axis of rotation near the axis of rotation of the first movable blade, and comprising a first slot for engaging the first engaging part disposed to the first movable blade, a second slot for engaging the second engaging part disposed to the second movable blade;

wherein the first movable blade travels bidirectionally through a specific range of circular motion following the movement of the linkage part, and the second movable blade travels bidirectionally through a specific range of circular motion in conjunction with the bidirectional motion of the first movable blade by means of the intervening connecting arm.

3. The printer of claim 2, further comprising a detection mechanism for detecting a reference position of the worm wheel.

4. The printer of claim 3, wherein the detection mechanism comprises:

a cam disposed to the worm wheel; and a detector for detecting the outside surface of the cam.

5. The printer of claim 4, further comprising:

a transportation mechanism located near the movable blade frame for nipping and conveying roll paper by means of a roller pair;

wherein the center of the transportation force applied by the roller pair to the roll paper and the position where the tips of the first and second movable blades intersect the stationary blade are substantially the same position relative to the roll paper width.

6. The printer of claim 1, wherein the stationary blade comprises:

first and second protrusions rendered at both end portions on the cuffing edge; and a third protrusions rendered in the middle on the side opposite the cutting edge;

wherein the first and second protrusions contact the movable blade frame and the third protrusion contacts the stationary blade frame when the cover frame is closed so that the cover frame is supported at three points.

7. The printer of claim 1, wherein the first and second movable blades are supported with the blade portions thereof inclined to the axes of rotation.

8. The printer of claim 7, further comprising:

first and second spacers disposed near the axes of rotation of the first and second movable blades; and first and second receiving members disposed between the first and second spacers and first and second movable blades and having substantially the same thickness as the stationary blade;

wherein the first movable blade is supported at an angle by the first spacer and first receiving member, and the second movable blade is supported at an angle by the second spacer and second receiving member.

9. The printer of claim 1, further comprising:

an exit opening for discharging the roll paper;

wherein the cover and the exit opening are disposed at the front of the printer.

10. The printer of claim 1, wherein:

the length of the blade part of the movable blade that follows is longer and the speed of movement is faster than another movable blade that leads.

11. The printer of claim 2, further comprising:

a middle gear disposed between the motor and the worm for transferring rotation of the motor shaft to the worm; and a clutch disposed between the middle gear and the worm.

12. The printer of claim 2, further comprising:

a manual operating member disposed to the worm shaft for rotating the worm.

* * * * *